US008991724B2

(12) United States Patent
Sesser et al.

(10) Patent No.: US 8,991,724 B2
(45) Date of Patent: Mar. 31, 2015

(54) WOBBLING SPRINKLER WITH VISCOUS BRAKE

(75) Inventors: George L. Sesser, Walla, WA (US); Craig B. Nelson, Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 248 days.

(21) Appl. No.: 13/489,748

(22) Filed: Jun. 6, 2012

(65) Prior Publication Data

US 2013/0327846 A1 Dec. 12, 2013

(51) Int. Cl.
*B05B 3/04* (2006.01)
*B05B 7/12* (2006.01)

(52) U.S. Cl.
CPC ..... *B05B 7/12* (2013.01)
USPC ..... 239/222.21; 239/222.11; 239/222.17; 239/233; 239/252; 239/381; 239/524

(58) Field of Classification Search
USPC ..... 239/222.11, 222.17, 222.21, 231, 232, 239/233, 252, 381, 524
See application file for complete search history.

(56) References Cited

U.S. PATENT DOCUMENTS

| | | | | |
|---|---|---|---|---|
| 2,848,276 | A | | 8/1958 | Clearman |
| 3,091,400 | A | | 5/1963 | Aubert |
| D253,364 | S | | 11/1979 | McFadden |
| 4,487,368 | A | | 12/1984 | Clearman |
| 4,773,594 | A | | 9/1988 | Clearman |
| RE33,823 | E | | 2/1992 | Nelson et al. |
| 5,297,737 | A | * | 3/1994 | Davisson ..... 239/222.17 |
| 5,372,307 | A | | 12/1994 | Sesser |
| 5,381,960 | A | | 1/1995 | Sullivan et al. |
| 5,409,168 | A | * | 4/1995 | Nelson et al. ..... 239/222.17 |
| 5,415,348 | A | | 5/1995 | Nelson |
| 5,439,174 | A | | 8/1995 | Sweet |
| 5,588,595 | A | | 12/1996 | Sweet et al. |
| 5,671,885 | A | | 9/1997 | Davisson |
| 5,950,927 | A | | 9/1999 | Elliott et al. |
| 6,176,440 | B1 | | 1/2001 | Elliott |
| 6,267,299 | B1 | | 7/2001 | Meyer |
| 6,341,733 | B1 | | 1/2002 | Sweet |
| 6,439,477 | B1 | | 8/2002 | Sweet et al. |
| 6,932,279 | B2 | | 8/2005 | Burcham |
| 7,070,122 | B2 | | 7/2006 | Burcham et al. |
| 7,100,842 | B2 | | 9/2006 | Meyer et al. |
| 7,395,977 | B2 | | 7/2008 | Pinch et al. |

(Continued)

FOREIGN PATENT DOCUMENTS

| | | |
|---|---|---|
| WO | 2007131270 | 11/2007 |
| WO | WO 2010/019850 | 2/2010 |

OTHER PUBLICATIONS

European Search Report dated Sep. 6, 2013 issued in European Patent Application No. 13170406.6, 7 pp.

*Primary Examiner* — Steven J Ganey
(74) *Attorney, Agent, or Firm* — Nixon & Vanderhye P.C.

(57) ABSTRACT

A sprinkler head includes a nozzle fixed within the sprinkler body, and a wobbler cage including a water deflector plate downstream of the nozzle mounted for rotating and wobbling motion relative to the sprinkler body. In certain embodiments, a viscous brake is fixed within the sprinkler body and includes a shaft rotatable about the longitudinal axis passing through the nozzle. The shaft is eccentrically coupled to the water deflector plate for slowing the rotating and wobbling motion of the wobbler cage and the water deflector plate.

7 Claims, 11 Drawing Sheets

(56) References Cited

U.S. PATENT DOCUMENTS

| | | | |
|---|---|---|---|
| 7,562,833 | B2 | 7/2009 | Perkins et al. |
| 7,942,345 | B2 | 5/2011 | Sesser et al. |
| 7,980,488 | B2 | 7/2011 | Townsend |
| 2006/0006254 | A1 | 1/2006 | Meyer et al. |
| 2006/0108445 | A1 | 5/2006 | Pinch et al. |
| 2006/0249594 | A1 | 11/2006 | Pinch |

* cited by examiner

WOBBLING SPRINKLER WITH VISCOUS BRAKE

BACKGROUND

This invention relates to sprinkler heads and, more particularly, to sprinkler heads that nutate, or wobble, while they rotate, to thereby minimize the "donut effect" prevalent with conventional rotating sprinkler heads.

Various nutating or wobbling sprinkler head designs have been proposed, examples of which are described in prior U.S. Pat. Nos. 5,381,960; 5,950,927; and 6,932,279. Commonly owned U.S. Pat. Nos. 5,439,174; 5,588,595; 5,671,885; 6,267,299; 6,341,733; 6,439,477; 7,287,710; 7,562,833; 7,942,345 and 8,028,932 provide further examples of nutating or wobbling sprinkler heads. There are potential shortcomings, however, that can nullify the very nutating affect that makes such sprinklers attractive in the first instance.

One problem often encountered with sprinklers of this type relates to stalling at start-up or even during normal operation. Stalling occurs when the water distribution plate of the sprinkler head fails to tilt at start-up, or ceases tilting during operation, thereby simply rotating and distributing a stream particularly susceptible to the "donut effect" where the wetted pattern area is shaped like a solid ring around a dry center. When nutating or wobbling sprinklers operate as designed, the nutating action tends to fill in the pattern in a substantially uniform manner. Thus, it is critical that the water distribution plate reliably and consistently remain in a tilted orientation on start-up and while rotating to achieve the desired wobbling or nutating action.

The stalling problem discussed above has been solved in different ways (see, for example, U.S. Pat. Nos. 5,381,960 and 6,341,733).

Another problem relates to the relatively high speed of rotation of the wobbling sprinkler head. High rotational speeds create the well-known but undesirable "horse-tail" effect that shortens the radius of throw of the sprinkler. While it has been shown that slowing the rotation of the sprinkler using a brake mechanism is effective to obtain maximum throw, completely satisfying solutions to the problem of slowing the rotation speed of a wobbling sprinkler head have yet to be developed. One attempt to slow a wobbling head is described in U.S. Pat. No. 7,395,977.

There remains a need for a wobbler-type sprinkler that effectively and reliably achieves maximum throw radius while maintaining the pattern-uniformity benefits of the wobbler-type sprinkler.

BRIEF SUMMARY OF THE INVENTION

In the exemplary but nonlimiting embodiments described herein, a viscous brake is eccentrically coupled to a wobbler cage supporting a deflection plate, or the viscous brake is incorporated into the wobbler cage and is eccentrically coupled to a stationary component of the sprinkler head.

Accordingly, in one exemplary but nonlimiting embodiment, there is provided a sprinkler head comprising a sprinkler body; a nozzle fixed within the sprinkler body; a water deflector plate downstream of the nozzle, mounted for rotating and wobbling motion relative to the sprinkler body; and a viscous brake fixed within the sprinkler body and including a shaft rotatable about a longitudinal axis passing through the nozzle, the shaft coupled to the water deflector plate for slowing the rotating and wobbling motion of the wobbler cage and the water deflector plate.

In another nonlimiting aspect, there is provided a sprinkler head comprising a sprinkler body having an inlet and supporting a nozzle for emitting a liquid stream along a first axis, the sprinkler body also supporting a deflector plate downstream of the nozzle, the deflector plate having grooves formed therein that are impinged upon by the liquid stream and that are curved to cause the deflector plate to rotate; the deflector plate loosely mounted on the sprinkler body causing the deflector plate to wobble as it rotates; and a viscous brake operatively coupled to the deflector plate, the viscous brake comprising a shaft, a rotor attached to the shaft and located in a chamber at least partially filled with a viscous fluid, the shaft fixed for rotation about and along the first axis and coupled to the deflector plate such that rotating and wobbling motion of the deflector plate causes rotation of the shaft and rotor about the first axis, the rotating and wobbling motion resisted by the viscous brake.

In still another exemplary but nonlimiting embodiment, there is provided a sprinkler head comprising a nozzle fixed within a sprinkler body; a water deflector assembly downstream of the nozzle, mounted for rotating and wobbling motion relative to the sprinkler body; a wobbler cage including a viscous brake supported within the wobbler cage for slowing the rotating and wobbling motion of the wobbler cage and the water deflector plate, the viscous brake including a shaft operatively coupled to a pin centered on a stationary cap portion of the sprinkler head.

In still another exemplary but nonlimiting embodiment, there is provided a sprinkler head comprising a sprinkler body having a longitudinal center axis; a nozzle supported in the sprinkler body, the nozzle having an orifice on the longitudinal axis; a wobbler cage including a multi-grooved water deflector plate downstream of the nozzle and adapted to receive a stream emitted from the nozzle; the wobbler cage tilted relative to the longitudinal center axis and mounted for rotating and wobbling motion relative to the sprinkler body; and a rotary brake located within the sprinkler body or the wobbler cage for slowing the rotating and wobbling motion of the wobbler cage and the water deflector plate, the rotary brake coupled between the wobbler cage and the sprinkler body.

The invention will now be described in detail in connection with the drawings identified below.

DETAILED DESCRIPTION

First Embodiment

Figure 1:
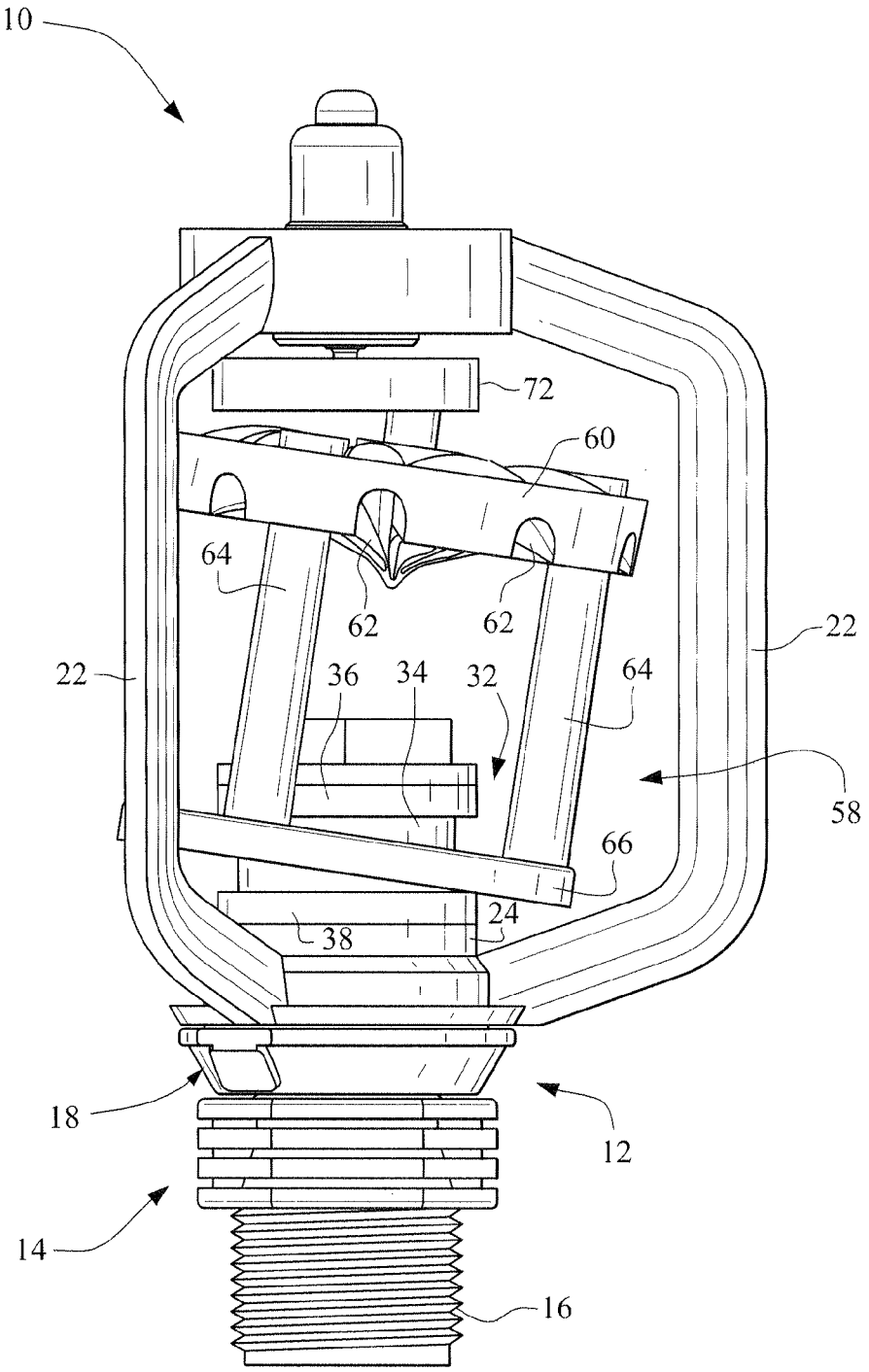
FIG. 1 is a side elevation view of a wobbler-type sprinkler head in accordance with a first exemplary but nonlimiting embodiment of the invention.
Figure 2:
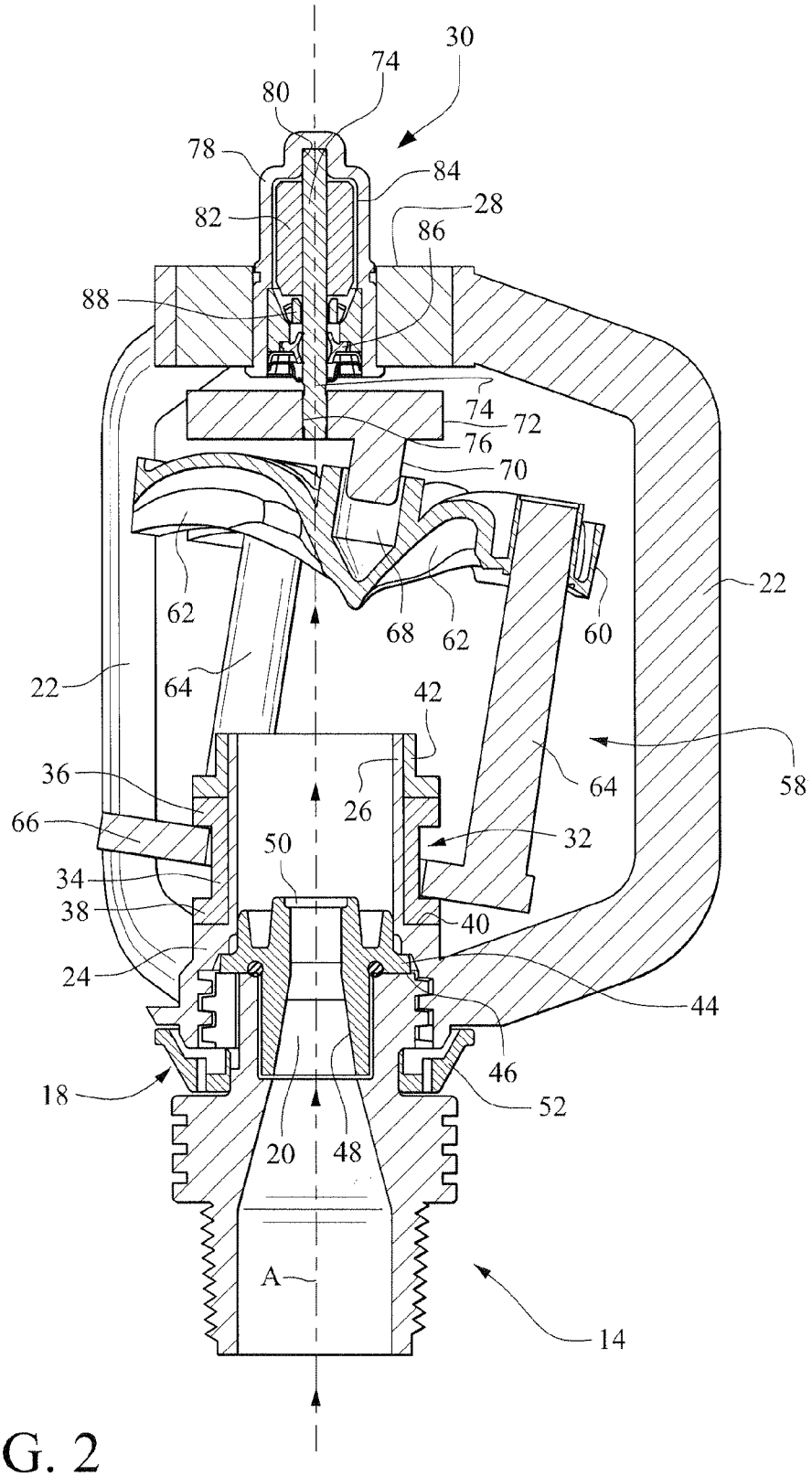
FIG. 2 is a vertical cross section through the sprinkler head shown in FIG. 1.
Figure 3:
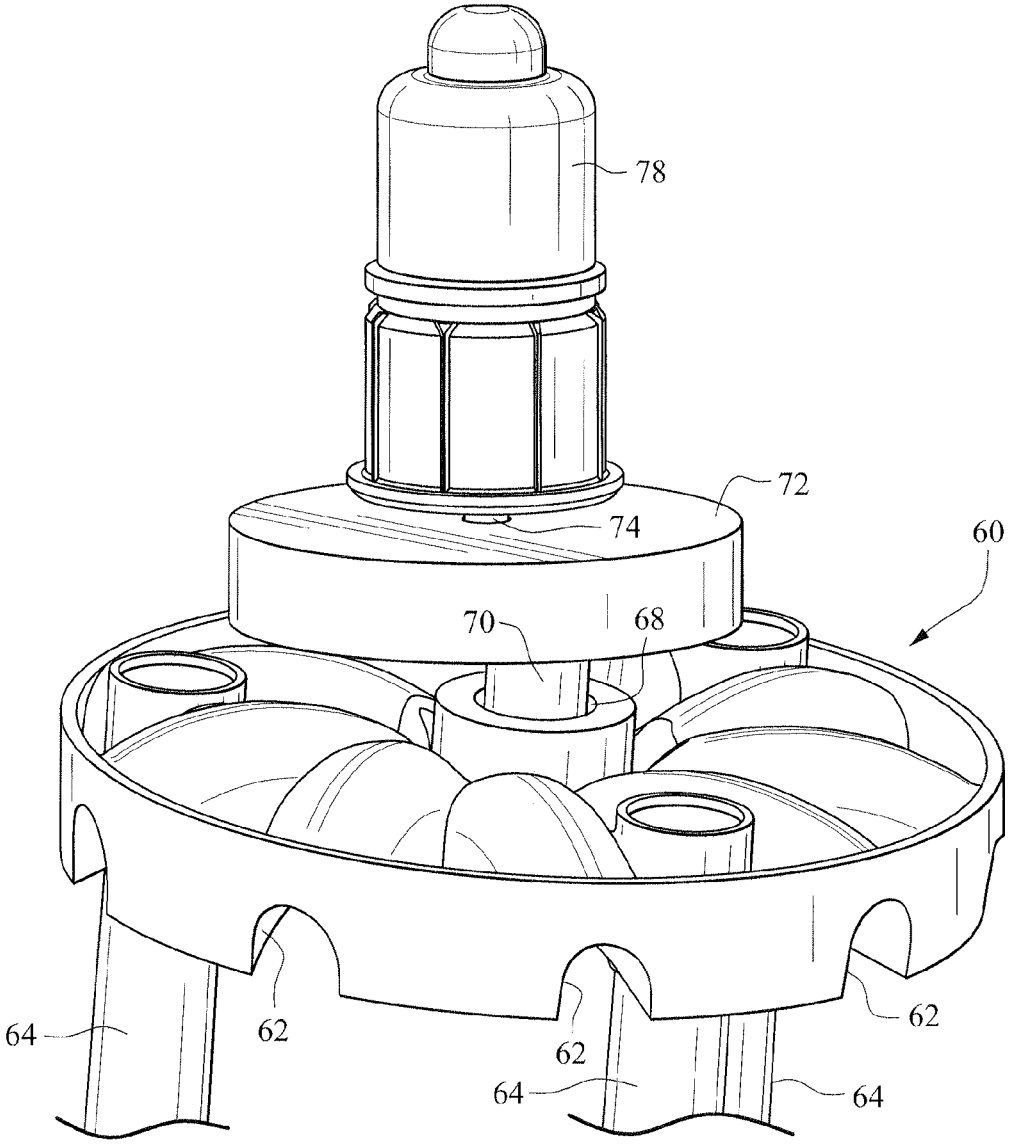
FIG. 3 is a partial-perspective view of the upper portion of the sprinkler head shown in FIGS. 1 and 2.

FIGS. 1-3 illustrate a sprinkler head 10 in accordance with first exemplary but nonlimiting embodiment of the invention. The sprinkler head 10 includes a sprinkler body assembly 12 which may include an inlet adapter 14 (attached by, for example, a threaded connection) that allows the sprinkler head to be attached to a flexible conduit, fixed riser or other irrigation component (such as a pressure regulator), utilizing the externally-threaded end 16 of the adapter. A nozzle body 18 is supported within the sprinkler body assembly, the nozzle bore 20 (FIG. 2) aligned with the inlet adapter 14 such that a stream of water (or other liquid) follows an axial path through the sprinkler body assembly. The manner in which the nozzle body 18 is secured within the sprinkler body will be described in detail further below. The sprinkler body assembly 12 also includes a plurality of upwardly-extending, outer struts or standards 22 integrally-formed at their lower ends with a lower substantially-cylindrical bushing 24 from which an internal cylindrical sleeve 26 extends upwardly, as best seen in FIG. 2. The struts 22 are engaged at their uppermost end with an upper substantially-cylindrical bushing 28 that supports a viscous brake assembly 30, also described further below.

A spool 32 is received over the sleeve 26 and includes a center hub 34 and upper and lower radially-extending flanges 36, 38, respectively. The lower bushing 24 is formed with a radial shoulder 40 on which the spool 32 rests. An upper retention ring 42 is telescopically received over the sleeve 26 and holds the spool 32 in place on the sleeve 26. It will be appreciated that the sprinkler body assembly, including the spool 32, remains stationary during operation.

The nozzle body 18 is formed with a radial flange 44 that engages an upper end 46 of the adapter 14. The internal bore 20 is tapered inwardly at 48, and leads to a nozzle orifice 50. The nozzle body 18 also includes an exterior identification ring 52 that permits the user to determine at a glance the orifice size of the nozzle. Thus, the nozzle body is sandwiched between the upper end 46 of the adapter and the bushing 24. It will be appreciated that the nozzle body 18 is easily removed and replaced by the same or different-size nozzle simply by unscrewing the adapter 14 and sliding the nozzle off the adapter. In this regard, the threads on the adapter are circumferentially discontinuous, leaving axially-oriented gaps or slots which receive circumferentially-spaced spokes or webs formed in the nozzle body. The nozzle body 18 is of known construction and is described in further detail in commonly-owned U.S. Pat. No. 5,415,348. The nozzle construction is not particularly relevant to this invention, however, and need not be described in any greater detail herein.

A wobbler cage 58 is supported on the spool 32. More specifically, the wobbler cage 58 includes a disc-like stream deflector or distribution plate 60 formed with a plurality of radially-extending, circumferentially-curved grooves 62. The deflector plate is supported on a plurality of posts 64 extending upwardly from a lower ring 66, and radially inward of the struts or standards 22. The lower ring 66 is loosely received over the hub 34, permitting rotating/wobbling movement of the wobbler cage 58 about the spool hub 34, but confined between the spool flanges 36, 38.

A bore or recess 68 is formed in the upper, center portion of the distribution plate 60 and opens in an upward direction so as to receive a pin 70 projecting downwardly from a brake disc 72. The pin 70 is offset from a brake shaft 74 so as to be located eccentrically relative to a center aperture 76 in the brake disc 72 which receives the shaft 74. The shaft 74 extends into the brake housing 78 and is received in a recess 80 at the remote end of the brake housing. A substantially-cylindrical rotor 82 is fixed to the shaft 74 within a chamber 84 in the brake housing 78 that is filled, or at least partly filled with a viscous fluid. The chamber 84 is sealed at its lower end by a shaft seal 86. A shaft bearing 88 located within the housing provides additional support for the shaft 74.

In operation, when a stream is emitted from the nozzle orifice 50, it strikes the deflector plate 60 and because the grooves 62 have a component of curvature in a circumferential direction, the deflector plate 60 and wobbler cage 58 are caused to rotate, and, as a result of the loose fit between the ring 66 and the spool 32, the wobbler cage 58 also wobbles as it rotates. As a result of this rotating/wobbling action, the wobbler cage 58 also rotates the disc 72, shaft 74 and the rotor 82 within the chamber 84. The rotation is resisted by the viscous fluid within the chamber 84 as the fluid is "sheared" between the rotor 82 and the chamber wall. This viscous fluid resistance or friction slows down the rotation of the shaft 74 and, through the brake disc 72, also slows the rotating/wobbling motion of the wobbler cage 58. Note that with the stream deflector and wobbler cage 58 are tilted or angled relative to the longitudinal axis A passing through the nozzle orifice 50 and coincident with the shaft 74, the pin or post 70 projects at a similar angle relative to the shaft 74 so as to properly seat in the recess 68 as the wobbler cage rotates and wobbles about the axis A. Note also that the pin 70 seated in the recess or bore 68 insures that the stream deflector and wobbler cage 58 will always remain tilted relative to the longitudinal axis A, thus precluding stalling under any conditions.

Figure 4:
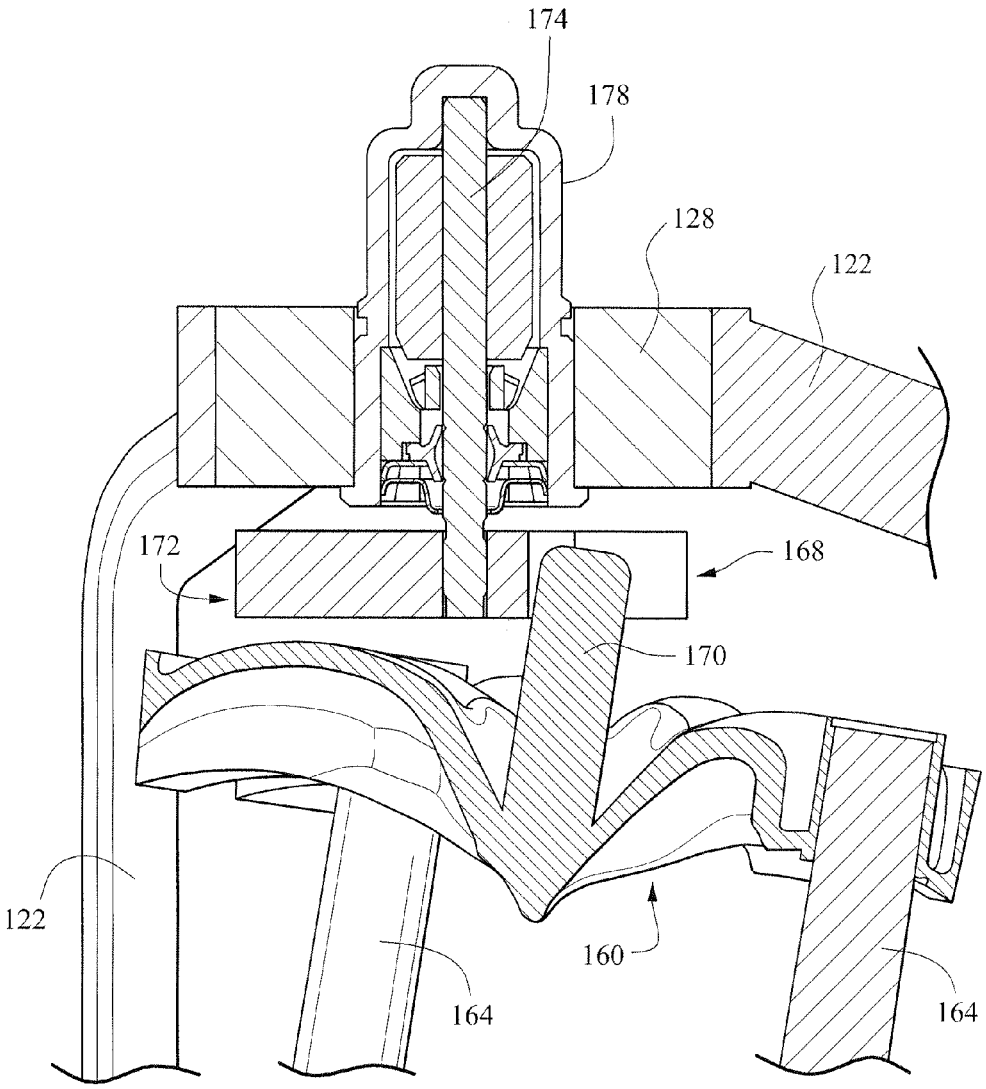
FIG. 4 is a partial, vertical cross section of the upper portion of a sprinkler head in accordance with a variation of the sprinkler head embodiment illustrated in FIGS. 1-3.
Figure 5:
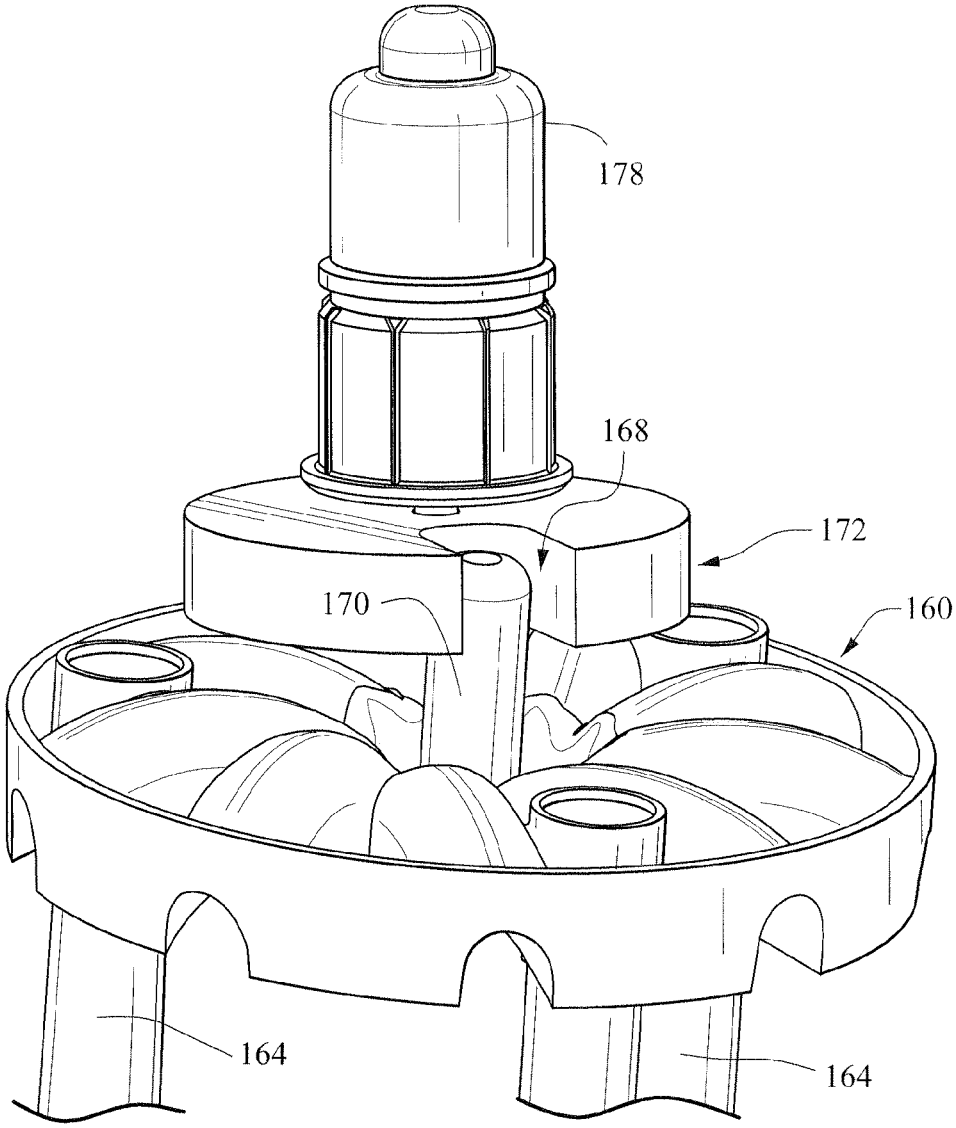
FIG. 5 is a partial-perspective view of the upper portion of the sprinkler head shown in FIG. 4.

FIGS. 4 and 5 illustrate an alternative construction where the brake disc 172 is formed with an open-ended slot 168 adapted to receive a post or pin 170 projecting upwardly from the deflector plate 160. In other words, the operative coupling elements between the deflector plate 160 and the eccentrically-located brake disc 172 have been reversed relative to the arrangement in FIGS. 1-3. In this instance, the open-ended slot 168 facilitates assembly, particularly with respect to locating the pin 170 when the wobbler cage 158 is installed on a sprinkler head. Otherwise, the construction and operation remains as described above in connection with FIGS. 1-3. In this regard, only those reference numerals that are required to understand the difference between the embodiment of FIGS. 4 and 5 and the embodiment of FIGS. 1-3 have been used in FIGS. 4 and 5. For ease of understanding, similar numbers, but with the prefix "1" added, are used to designate the different but corresponding component parts.

Second Embodiment

Figure 6:
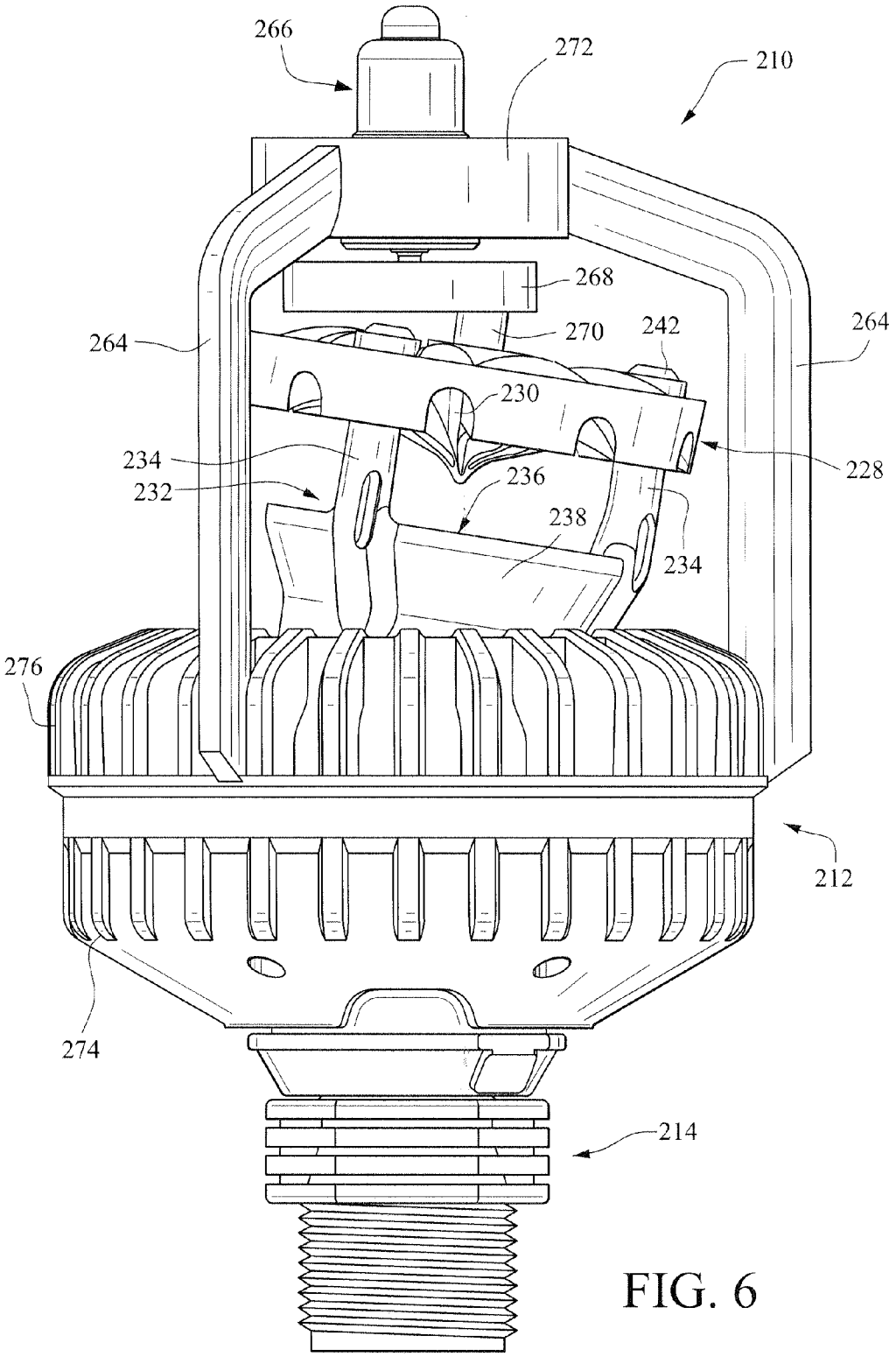
FIG. 6 is a side elevation of a sprinkler head in accordance with a second exemplary but nonlimiting embodiment.
Figure 7:
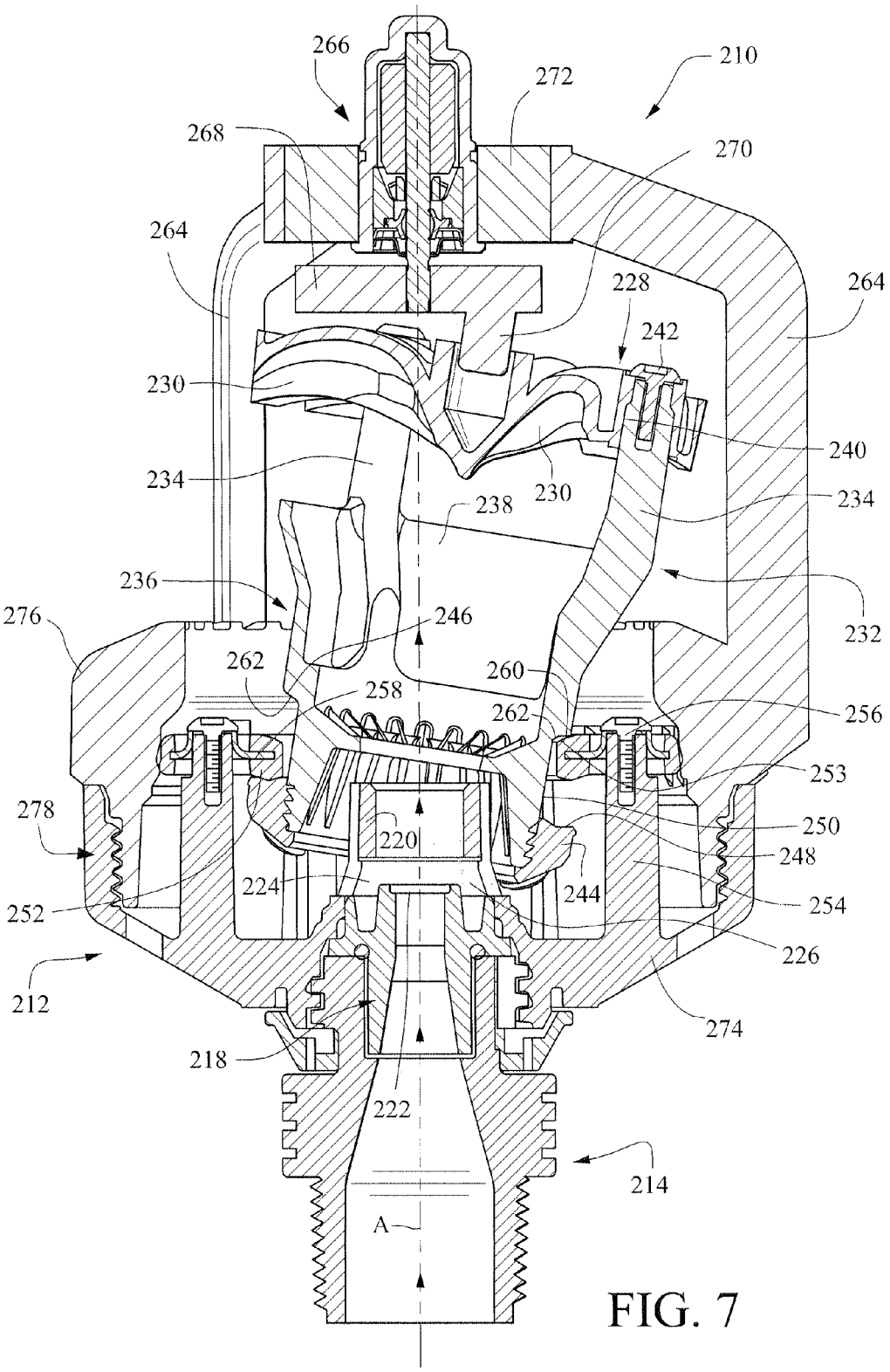
FIG. 7 is a vertical cross section taken through the sprinkler head in FIG. 6.

FIGS. 6 and 7 illustrate another exemplary but nonlimiting embodiment where the wobbler cage orbits and wobbles about an annular race supported on the sprinkler body. More specifically, FIGS. 6 and 7 show a sprinkler head 210 that includes a sprinkler body assembly (or simply, "sprinkler body") 212 fitted with an adapter 214 and supporting a nozzle body 218 in substantially the same manner as described above in connection with the first embodiment.

A sleeve 220 is integrally formed with or attached to the sprinkler body 212, and extends downstream (upwardly as viewed in FIGS. 6 and 7) of the nozzle orifice 222, with the lower portion of the sleeve slotted (as at 224 and 226) permitting air to flow into the nozzle area to enhance stream integrity as the stream exits the end of the sleeve 220. As in the previously-described embodiment, a water-deflector plate 228 is provided with plural radially-oriented grooves 230, some or all of which are curved in a circumferential direction to cause the plate 228 to rotate when impinged upon by a stream emitted from the nozzle body 218.

The water deflector plate 228 is supported on a wobbler cage 232 for wobbling or nutating motion about the axis A passing through the nozzle body 218, as viewed in FIG. 7. More specifically, the water-deflector plate 228 is supported on three circumferentially-spaced posts 234 (two shown in each of FIGS. 6 and 7). The posts 234 in the exemplary embodiment are molded integrally with an upper end of an upper spool component 236 of the wobbler cage 232 extending substantially vertically upwardly from an upstanding, partially conical, peripheral wall 238 to the water deflector plate 228. The upper ends of the posts may extend through apertures 240 in the plate 228 as best seen in FIG. 7, and secured by screws 242 or other fasteners such as lock-washers, or alternatively by means of, for example, heat and pressure applied to the tips of the posts, i.e., by heat staking.

The upper spool component 236 is threadably attached to a lower spool component 244. This split-spool arrangement is employed primarily to facilitate manufacture, but a one-piece spool is not outside the scope of this invention. As best seen in FIG. 7, the upper spool component 236 is formed with an upper, substantially radially-oriented spool flange 246 and the lower spool component 244 is formed with a substantially radially-oriented upper surface 248 serving as a lower spool flange. The upper spool flange 246 and the lower spool flange 248 are connected by a substantially-cylindrical hub surface 250.

An annular race 252 is secured to an upstanding-internal, annular wall 254 of the sprinkler body 212 by screws or other fasteners 256. The race 252 may be made of a hard rubberized plastic (or other suitable material), molded about an annular metal flange 258 which facilitates attachment to the wall 254. The upper surface 253 of the race is formed with traction teeth 260 adapted to engage similar teeth 262 formed on the upper spool flange 246 as the cage 232 wobbles about the race. The number of teeth on the respective surfaces differs by at least one, thus changing the relative location of the grooves 230 on each "orbit" of the race to facilitate an even more uniform pattern by preventing dry spokes between the streams emitting from the grooves in the deflector plate.

The manner in which brake disc 268, pin 270 and viscous brake 266 (supported in the bushing 272) work in connection with the wobbler cage 232 (and specifically the deflector plate 228) is otherwise as explained above in connection with the first embodiment.

In this second embodiment, the sprinkler body 212 is formed into separable components, a lower portion 274 supporting the adapter 214 and nozzle body 218; and an upper portion 276 that includes the struts or standards 264 and the viscous brake 266. The upper and lower portions 274, 276 are connected by, for example, a threaded attachment as shown at 278. This arrangement, in combination with the tapered wall 238 of the spool 232 and the air flow through the sleeve 220, provides effective shielding for the nozzle body 218, preventing or at least minimizing the collection of debris in and/or around the sleeve 220 and nozzle orifice 222.

Third Embodiment

Figure 8:
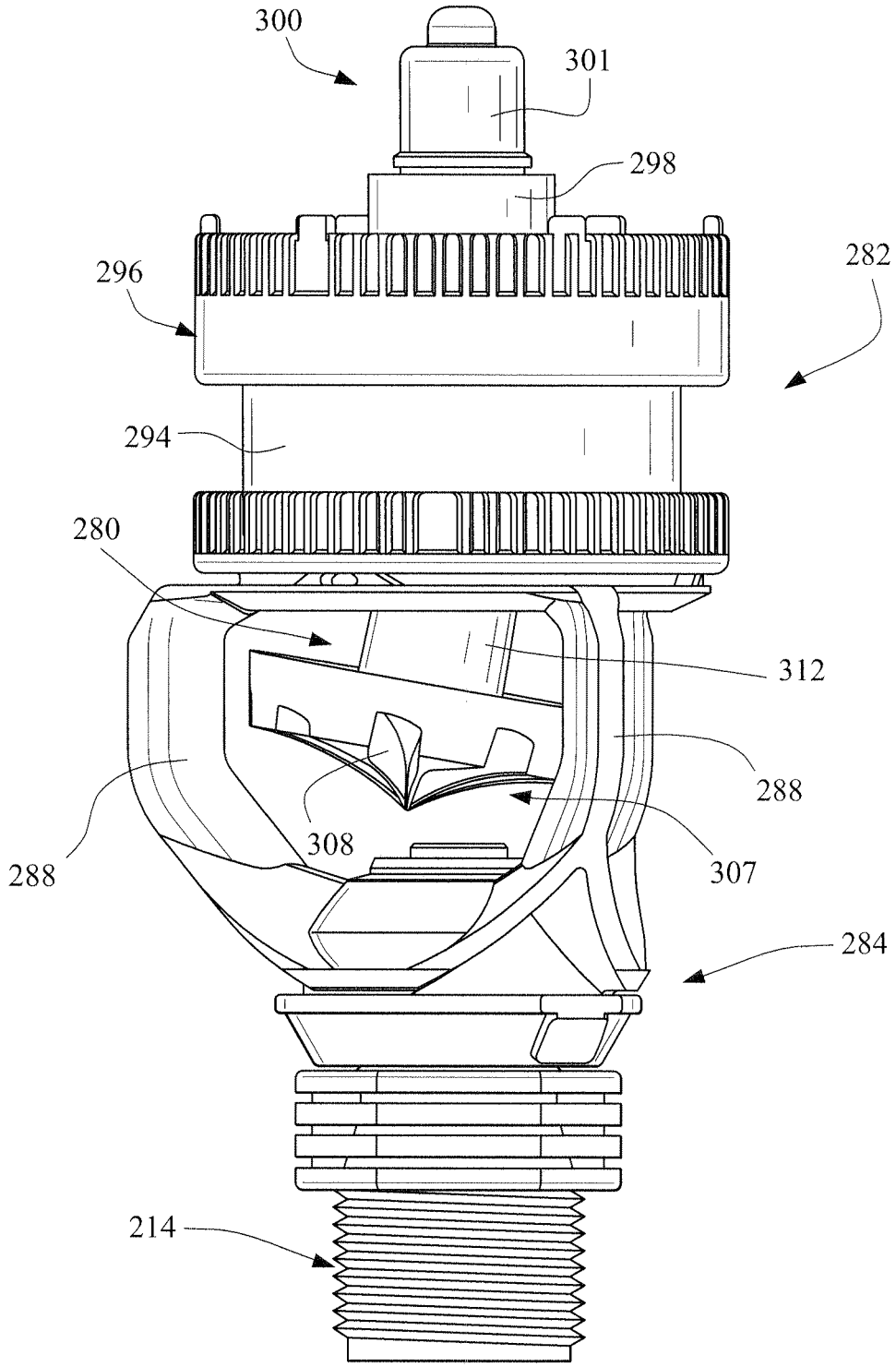
FIG. 8 is a side elevation of a third exemplary embodiment of the invention.
Figure 9:
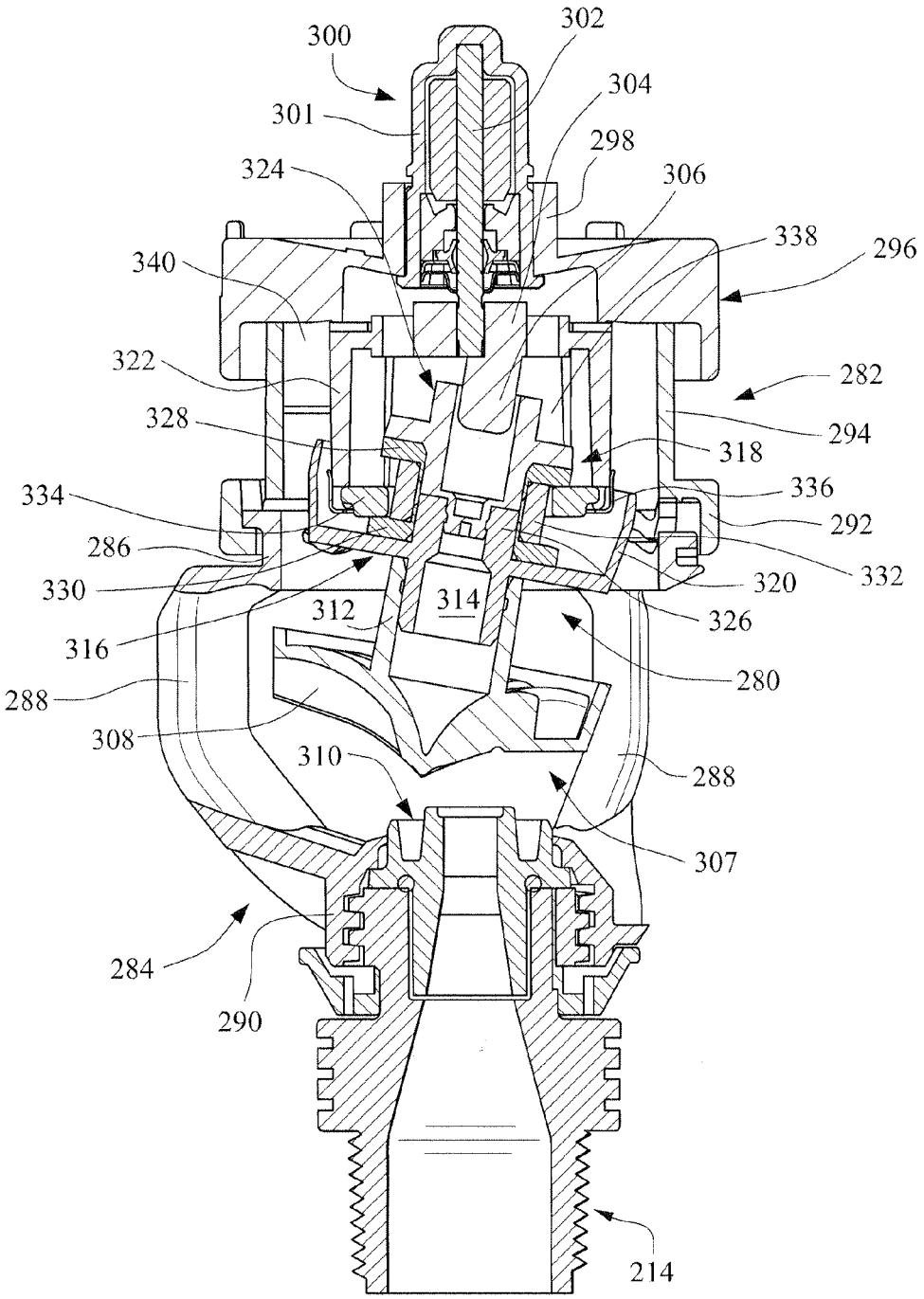
FIG. 9 is a vertical cross section taken through the sprinkler head shown in FIG. 8.

In another exemplary embodiment shown in FIGS. 8 and 9, a wobbler cage 280 is incorporated into a sprinkler body cap assembly 282 that is removably attached to a sprinkler body 284. More specifically, as best seen in FIG. 9, the sprinkler body 284 includes an upper ring 286 which is supported by circumferentially-spaced standards 288 extending upwardly from a hub portion 290 of the sprinkler body.

The cap assembly 282 includes a lower flange portion 292 that attaches to the upper ring 286 by means of a bayonet, snap-fit, threaded or other suitable connection. An outer cap wall 294 extends upwardly from the lower flange portion 292 to an upper cap portion 296. The upper cap portion 296 is formed with a center hub 298 that supports the viscous brake 300 in a manner similar to the viscous brake mounting arrangement shown in FIGS. 1 and 2. In this regard, the brake housing 301 may be snap-fit or otherwise suitably secured within the center hub 298.

The viscous brake shaft 302 extends beyond the viscous brake housing 301 and mounts the brake disc 304. The brake disc 304 is formed with an angled, eccentric pin 306 that is received in the wobbler cage 280 as described further below.

The wobbler cage 280 includes a water deflector plate 307 provided with distribution grooves 308 similar to those described in connection with the embodiments of FIGS. 1-7 that cause the plate 307 to rotate when impinged upon by a stream emitted from the nozzle 310. A cylindrical stem 312 of the plate 307 is telescopically received over a bushing 314 of a lower spool component 316 of a spool assembly 318, in a snap-fit, press-fit or other suitable attachment arrangement. The lower spool component 316 is shaped to provide peripheral shield 320 that, in combination with the outer, annular cap wall 294 and the inner annular wall 322, substantially encloses the spool assembly 318, preventing ingress of debris that might otherwise hamper the nutating/wobbling action of the wobbler cage 280. An upper spool component 324 is press and/or snap-fit into the lower spool component 316 at 326.

The spool assembly 318 comprises upper and lower rings 328, 330, each of which has a cylindrical component which enables the rings to be telescoped over opposed bushing portions of the upper and lower spool components 324, 316. The rings 328, 330 are separated by a sleeve or spacer 332 that serves as the spool hub.

The spool assembly 318 is loosely secured within an annular ring or race 334 that may be made of suitable wear-resistant material, such as a ceramic. An annular retainer 336 is secured to the race and press or snap-fit over the inner wall 322 so as to hold the race in place. The spool assembly 318 is thus received in a center cavity 338 defined by the inner annular wall 322 of the cap assembly. The inner annular wall 322 is supported by (or integrated with) the outer annular cap wall 294 by means of circumferentially-spaced ribs (one shown in FIG. 9 at 340).

As noted above, the upper end of the upper spool component 324 receives the pin 306 projecting from the brake disc 304. The viscous brake 300 reduces the speed of the wobbler cage 280 via the coupling at pin 306 and upper spool component 324 in the same manner as described above in connection with the earlier-described embodiments.

Fourth Embodiment

Figure 10:
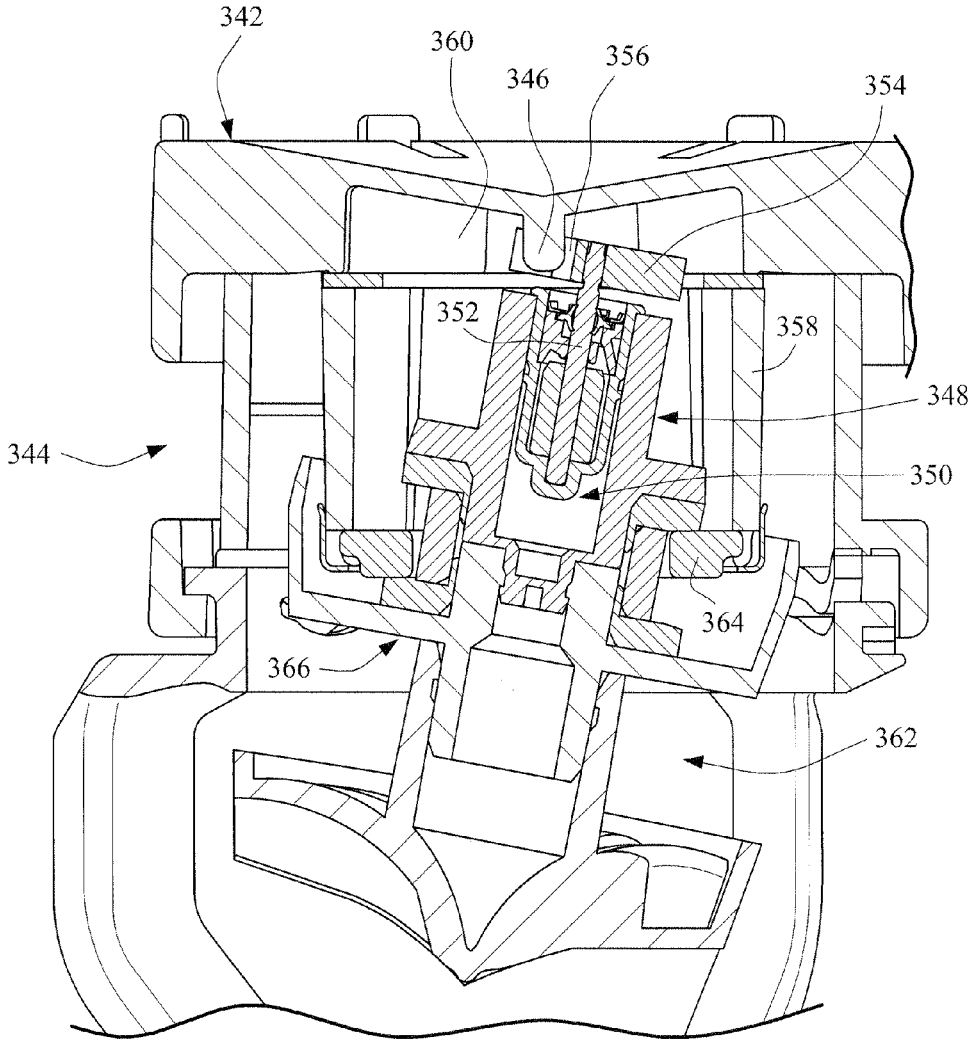
FIG. 10 is a vertical cross section taken through the upper portion of a sprinkler head in accordance with another exemplary but nonlimiting embodiment of the invention.
Figure 11:
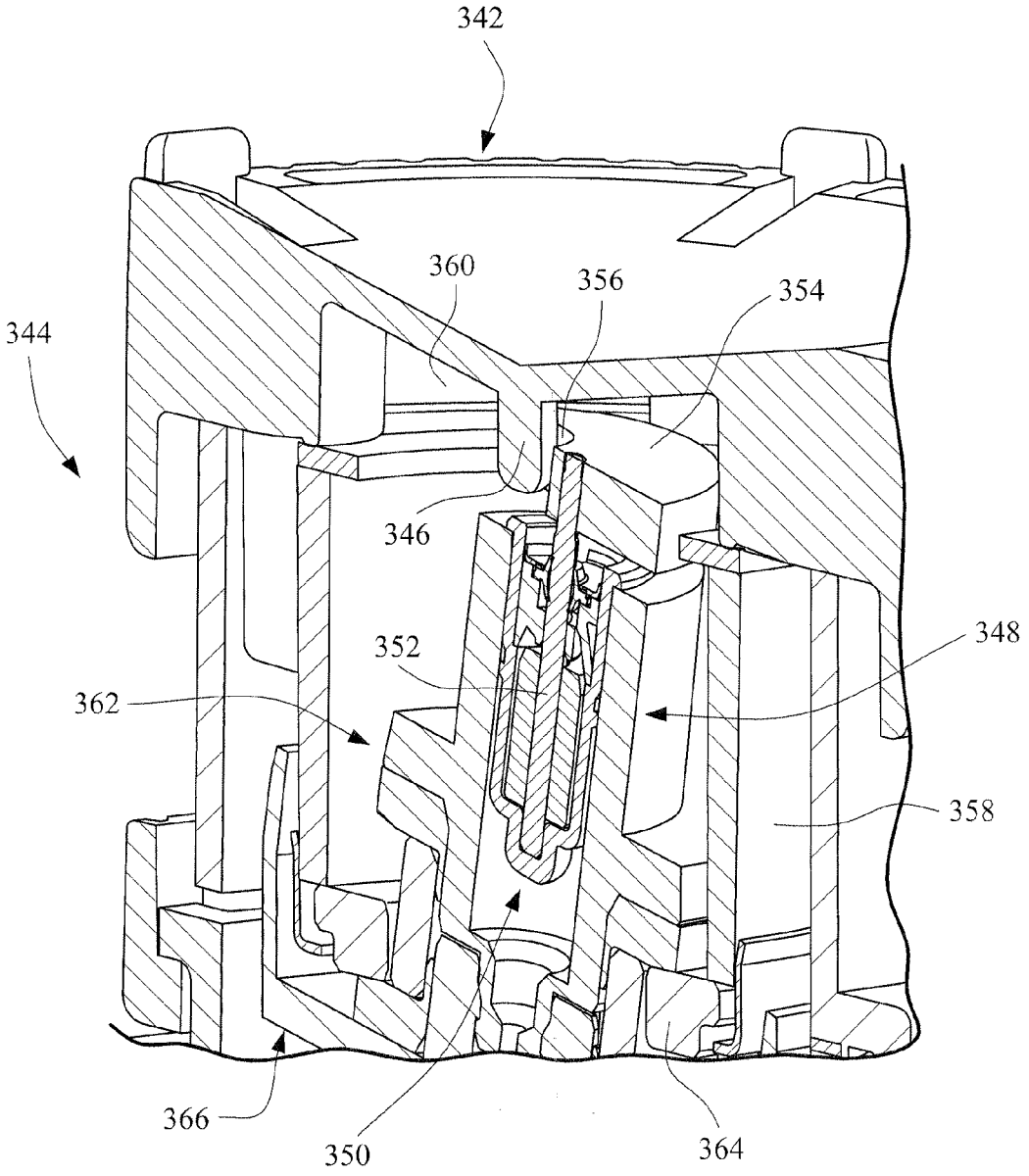
FIG. 11 is a sectioned, partial-perspective view of the upper portion of the sprinkler head shown in FIG. 10.

Turning to FIG. 10, a fourth exemplary embodiment is illustrated wherein the viscous brake assembly has been moved to a location within the wobbler cage. More specifically, the upper cap component 342 of the cap assembly 344 has been modified (as compared to FIGS. 8 and 9) to include a centrally-located pin or post 346. At the same time, the upper spool component 348 has been lengthened to provide sufficient space to house the viscous brake assembly 350. The brake shaft 352 extends out of the brake assembly and secures the brake disc 354 which is formed with an offset round or oblong aperture 356 that receives the pin or post 346. As in the previous embodiment, the space enclosed by the internal wall 358 and the space 360 provided within the upper cap portion 342 is sufficient to allow the wobbler cage 362 to wobble freely as it rotates about the annular race 364. In this regard, with the exception of the extended upper spool component, the remainder of the wobbler cage 362 is substantially identical to the wobbler cage arrangement of FIGS. 8 and 9. It will also be appreciated that the remainder of the sprinkler body including the nozzle and adapter configuration is also substantially identical to that shown in FIGS. 8 and 9.

It should also be noted that the lower spool component 366 may be constructed of any suitably heavy metal material, e.g., brass, to also serve as a counterweight that promotes a controlled nutating action of the wobbler cage 362.

This arrangement reduces the overall profile of the sprinkler and provides better protection for the viscous brake assembly 350.

All the figures show a simple viscous brake such as is disclosed in commonly-owned U.S. Pat. Nos. RE 33,823 and 5,372,307. However, more complex viscous brakes such as disclosed in commonly-owned U.S. Pat. No. 7,980,488 could be used as well to impart fast/slow rotation if desired. It will be understood, however, that non-viscous types of rotary brakes of various types could be used, including mechanical friction brakes and magnetic brakes. In addition, and as made apparent from the embodiments described above, the brake may be incorporated into either the sprinkler body or the wobbler cage, but the invention does not exclude the possibility of brake components in both the sprinkler body and the wobbler cage.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler head comprising:

a sprinkler body having a longitudinal center axis and provided with a nozzle at one end and a cap component at an opposite end;

a wobbler cage including a water deflector plate assembly between said nozzle and said cap component, mounted for rotating and wobbling motion relative to said sprinkler body;

a viscous brake supported within said wobbler cage for slowing the rotating and wobbling motion of the wobbler cage and the water deflector plate, said viscous brake including a shaft oriented at an angle relative to said longitudinal center axis and operatively coupled to a pin centered on said cap component of said sprinkler body; and a brake disc receiving said shaft in a center aperture and acting on said wobbler cage via said cap component, wherein rotation of said wobbler cage is slowed by the rotary brake through the brake disc.

2. The sprinkler head of claim 1, wherein said disc is formed with a recess offset from said shaft and receiving said pin.

3. The sprinkler head of claim 1 wherein said wobbler cage includes a spool component having spaced, upper and lower flanges; said sprinkler body supporting stationary annular race, opposite side of which are engageable by said upper and lower flanges as said wobbler cage rotates and wobbles relative to said sprinkler body.

4. A sprinkler head comprising:

a sprinkler body having a longitudinal center axis;

a nozzle supported in said sprinkler body, said nozzle having an orifice on said longitudinal axis;

a wobbler cage including a multi-grooved water deflector plate downstream of said nozzle and adapted to receive a stream emitted from said nozzle; said wobbler cage tilted relative to said longitudinal center axis and mounted for rotating and wobbling motion relative to said sprinkler body;

a rotary brake including a brake shaft located within said sprinkler body or said wobbler cage for slowing the rotating and wobbling motion of the wobbler cage and the water deflector plate, said rotary brake coupled between said wobbler cage and said sprinkler body; and a brake disc receiving said brake shaft in a center aperture and acting on said water deflector plate, wherein rotation of said wobbler cage is slowed by the rotary brake through the brake disc.

5. The sprinkler head of claim 4 wherein said rotary brake is supported in said sprinkler head and coupled to said deflector plate via said shaft mounting said brake disc provided with a post offset from said shaft, wherein said post is received in a recess in a center of said water deflector plate.

6. The sprinkler head of claim 4 wherein said rotary brake is supported in said sprinkler head and coupled to said deflector plate via said shaft mounting said brake disc formed with a recess offset from said shaft; and wherein a post projecting from a center of said water deflector plate is received in said recess.

7. The sprinkler head of claim 4 wherein said rotary brake is supported within said wobbler cage and wherein said shaft, angled relative to said longitudinal center axis, is operatively coupled between said wobbler cage and a pin on said sprinkler body, centered on said longitudinal center axis.

* * * * *